US012305373B2

(12) United States Patent
Kim

(10) Patent No.: US 12,305,373 B2
(45) Date of Patent: May 20, 2025

(54) SANITARY FAUCET

(71) Applicant: Jun Sik Kim, Seoul (KR)

(72) Inventor: Jun Sik Kim, Seoul (KR)

( * ) Notice: Subject to any disclaimer, the term of this patent is extended or adjusted under 35 U.S.C. 154(b) by 162 days.

(21) Appl. No.: 18/270,858

(22) PCT Filed: Nov. 29, 2021

(86) PCT No.: PCT/KR2021/017771
§ 371 (c)(1),
(2) Date: Jul. 4, 2023

(87) PCT Pub. No.: WO2022/154253
PCT Pub. Date: Jul. 21, 2022

(65) Prior Publication Data

US 2024/0068211 A1 Feb. 29, 2024

(30) Foreign Application Priority Data

Jan. 12, 2021 (KR) ..... 10-2021-0004127

(51) Int. Cl.
*E03C 1/04* (2006.01)

(52) U.S. Cl.
CPC ..... *E03C 1/0412* (2013.01); *E03C 1/0403* (2013.01)

(58) Field of Classification Search
CPC . E03C 1/052; E03C 2001/0414; E03C 1/0403
(Continued)

(56) References Cited

U.S. PATENT DOCUMENTS

2011/0240900 A1* 10/2011 Gordon ..... E03C 1/0412 251/339
2016/0265201 A1* 9/2016 Hoogendoorn ..... F16K 11/06

FOREIGN PATENT DOCUMENTS

CN 2616779 Y 5/2004
CN 2632447 Y 8/2004
(Continued)

OTHER PUBLICATIONS

English Specification of CN2616779Y.
(Continued)

*Primary Examiner* — Lauren A Crane
(74) *Attorney, Agent, or Firm* — ANTONIO HA & U.S. PATENT, LLC

(57) ABSTRACT

The present invention relates to a sanitary faucet which, in the process of turning off water, enables washing a knob which is touched in order to turn the water on/off, and thus enables promoting the hygienic use thereof. The sanitary faucet comprises: a faucet housing which forms a water supply channel by being connected to water supply lines, and is provided with an outlet for discharging water; a water supply valve which is installed on the faucet housing and is operated by being pressed by a user so as to supply or shut off water in the supply channel; and a sanitary knob which is disposed between the outlet and the water supply valve in a state of being installed on the faucet housing such that the tilt thereof may be adjusted so as to press the water supply valve by being touched by the user, and is formed so as to extend to the front of the faucet housing so as to guide water discharged from the outlet to the front of the faucet housing when the water is supplied by the water supply valve, and holds a portion of the water while forming a levelled state when the water is supplied by the water supply valve, and when the water supply valve is shut off, forms a tilted state so as to guide the held water to the front of the faucet housing, thereby washing the portion which was touched by the user.

6 Claims, 4 Drawing Sheets

(58) Field of Classification Search
USPC ..... 251/340, 339; 4/676
See application file for complete search history.

(56) References Cited

FOREIGN PATENT DOCUMENTS

| | | | |
|---|---|---|---|
| CN | 2637855 | Y | 9/2004 |
| CN | 201133512 | Y | 10/2008 |
| CN | 201575161 | U | 9/2010 |
| CN | 203821504 | U | 9/2014 |
| CN | 207525824 | U | 6/2018 |
| CN | 109899535 | A | 6/2019 |
| EP | 2700758 | B1 | 8/2018 |
| JP | H11-280948 | A | 10/1999 |
| KR | 10-2009-0120226 | | 11/2009 |
| KR | 20-0447109 | | 12/2009 |
| KR | 10-2011-0114935 | | 10/2011 |
| KR | 10-1639164 | | 7/2016 |

OTHER PUBLICATIONS

English Specification of CN2632447Y.
English Specification of CN2637855Y.
English Specification of CN109899535A.
English Specification of CN201133512Y.
English Specification of EP2700758B1.
English Specification of JPH11-280948A.
English Specification of 10-2009-0120226.
English Specification of 20-0447109.
English Specification of CN201575161U.
English Specification of 10-1639164.
English Specification of CN203821504U.
English Specification of CN207525824U.
English Specification of 10-2011-0114935.

* cited by examiner

SANITARY FAUCET

TECHNICAL FIELD

The present invention relates to a sanitary faucet, and more particularly, to a sanitary faucet capable of promoting sanitary use by allowing a knob touched to turn on/off water to be washed in the process of turning off the water.

BACKGROUND ART

In general, faucets are for supplying water from tap water, which are mostly configured such that a hot water pipe and a cold water pipe are coupled to the rear of the main body, and opening and closing of water and mixing of hot and cold water are controlled by a lever-type handle or a rotary handle configured to rotate up and down or left and right.

These faucets have been installed and used in hospitals, food processing factories, and various public institutions, as well as homes for a long time.

Here, a conventional general faucet is configured in such a way that the lever is operated to wash hands, and then the lever is operated again to lock the water.

However, the conventional faucet has a problem in that the hand is contaminated again by the lever because the lever must be operated by hand in the process of turning off the water after washing the hand.

In particular, there is a problem in that when a faucet is used in a hospital or food processing plant where hygiene is important, the lever is operated again with a cleanly washed hand, and bacteria parasitic on the lever contaminates the washed hand.

Accordingly, in recent years, as a means to solve the above problems, a device for controlling the supply of water to a faucet using a foot or a device for controlling water supply by opening and closing an electronic valve using a signal detected by an electronic sensor and the like are provided.

However, among the prior art as described above, the former has a complicated configuration and many difficulties in installation, and the latter has problems such as high facility costs and concerns about electrical failure.

Therefore, there is a need to solve the problems of the prior art as described above.

Prior art in the technical field to which the present invention belongs includes Korean Utility Model Registration No. 20-0447109 and the like.

DISCLOSURE

Technical Problem

The present invention is derived to solve the problems of the prior art as described above, and an object of the present invention is to provide a sanitary faucet capable of promoting sanitary use by allowing a knob touched to turn on/off water to be washed in the process of turning off the water.

Specifically, an object of the present invention is to provide a sanitary faucet capable of washing the sanitary knob with the remaining water when the sanitary knob is turned off by guiding the discharged water to the upper surface of the sanitary knob touched by the user and allowing some of the water to remain on the sanitary knob.

Particularly, an object of the present invention is to provide a sanitary faucet capable of washing a sanitary knob through the flow of received water by allowing a portion of water to be smoothly received on the upper surface of the sanitary knob and allowing the sanitary knob to incline when the water is turned off.

Further, an object of the present invention is to provide a sanitary faucet capable of adjusting and supplying a mixed amount of cold water and hot water.

Technical tasks that may be obtained from the disclosed embodiments are not limited to the above-mentioned purposes, and other technical tasks not mentioned are clearly understood by those skilled in the art to which the embodiments disclosed below belong.

Technical Solution

The sanitary faucet according to an embodiment of the present invention for achieving the above object may comprise a faucet housing which forms a water supply channel by being connected to water supply lines, and is provided with an outlet for discharging water, a water supply valve which is installed on the faucet housing and is operated by being pressed by a user so as to supply or shut off water in the supply channel, and a sanitary knob which is disposed between the outlet and the water supply valve in a state of being installed on the faucet housing such that the incline thereof may be adjusted so as to press the water supply valve by being touched by the user, and is formed so as to extend to the front of the faucet housing so as to guide water discharged from the outlet to the front of the faucet housing when the water is supplied by the water supply valve, and holds a portion of the water while forming a levelled state when the water is supplied by the water supply valve, and when the water supply valve is shut off, forms a tilted state so as to guide the held water to the front of the faucet housing, thereby washing the portion which was touched by the user.

Further, the sanitary knob may further comprise a knob body forming a horizontal or inclined state by the operation of the water supply valve while the lower surface is supported by the water supply valve in a state of being installed in the faucet housing and having an upper surface which is formed in a flat shape and receiving, when it is in a horizontal state, a portion of the water while guiding the water falling from the discharge port.

Further, the sanitary knob may further comprise a receiving groove formed on the upper surface of the knob body to form a groove and receiving water in a horizontal state of the knob body and groove guides installed vertically on both sides of the receiving groove to form a wall and receiving water together with the receiving groove.

Further, the water supply valve may be installed to be able to protrude from the faucet housing to adhere to the lower surface of the sanitary knob, open the supply path by pressing the sanitary knob and protrudes to support the sanitary knob in a horizontal state, and close the supply path by repetitive pressing of the sanitary knob to support the sanitary knob in an inclined state.

Further, the water supply line may comprise a hot water line supplying hot water to the faucet housing and a cold water line supplying cold water to the faucet housing.

Further, the sanitary faucet may further comprise a mixing valve built into the faucet housing to be connected to the hot water line and the cold water line, thereby mixing hot water and cold water and supply the mixture to the water supply valve, and a hot water control knob rotatably installed in the faucet housing while being connected to the mixing valve and rotates by a user to set the mixing amount of hot water and cold water of the mixing valve.

Advantageous Effects

According to the sanitary faucet according to an embodiment of the present invention, the sanitary knob that turns on and off the water supply valve receives a portion of water on the upper surface when water is supplied, and when the water is shut off, the user's touch area is washed with the received water, so infection or propagation of bacteria by the knob can be prevented.

Further, according to the sanitary faucet according to an embodiment of the present invention, the receiving groove and the groove guides are formed on the upper surface of the knob body constituting the sanitary knob, so that a portion of the water is smoothly received even when the knob body is in a horizontal state, and when the knob body inclines, the upper surface of the knob body may be washed smoothly.

Further, according to the sanitary faucet according to an embodiment of the present invention, the water supply valve protrudes or is drawn in by repetitive pressing of the sanitary knob in close contact with the lower surface of the sanitary knob, so that the sanitary knob can be supported in a horizontal or inclined state by the water supply valve during the water on/off process.

Further, according to the sanitary faucet according to an embodiment of the present invention, the mixing valve and the hot water control knob are provided, so that a mixing amount of hot water supplied from the hot water line and cold water supplied from the cold water line can be adjusted and supplied.

The effects of the present invention are not limited to the effects mentioned above, and other effects not mentioned will be clearly understood by those skilled in the art from the description of the claims.

MODE FOR INVENTION

Figure 1:
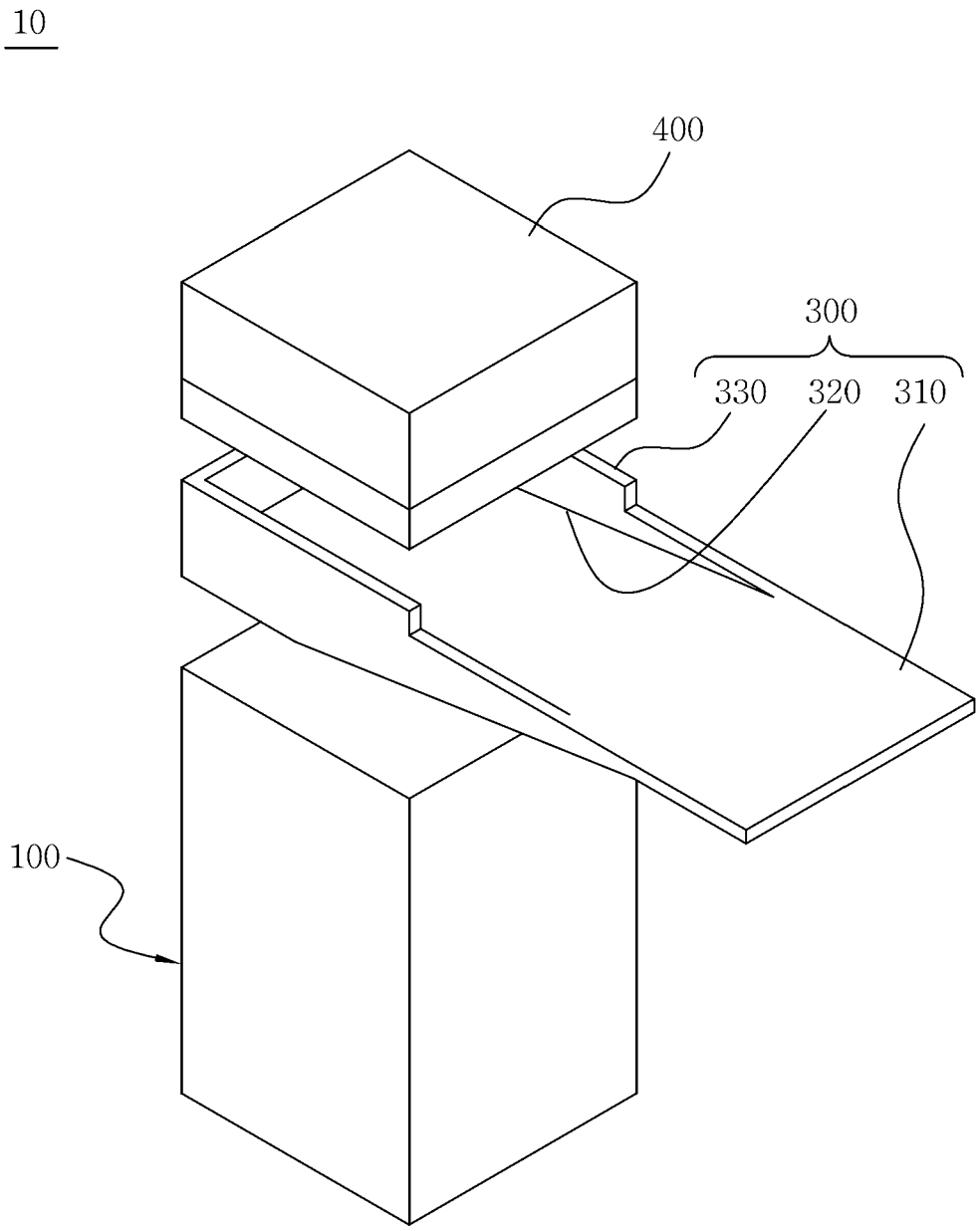
FIG. 1 is a perspective view showing a sanitary faucet according to an embodiment of the present invention.

Hereinafter, the embodiments disclosed in this specification are described in detail with reference to the accompanying drawings, but the same or similar components are assigned the same reference numerals regardless of reference numerals, and redundant descriptions thereof are excluded. The suffixes "module" and "unit" for components used in the following description are given or used only in consideration of ease of writing the specification and do not have meanings or roles that are distinct from each other by themselves.

Further, in describing the present invention, if it is determined that a detailed description of related known technologies may unnecessarily obscure the subject matter of the present invention, the detailed description is excluded. Further, it should be understood that the accompanying drawings are only for easy understanding of the embodiments disclosed in this specification, the technical idea disclosed in this specification is not limited by the accompanying drawings, and all changes, equivalents or substitutes are included in the spirit and technical scope of the present invention.

Further, terms including ordinal numbers, such as first and second, may be used to describe various components, but the components are not limited by the terms. These terms are only used for the purpose of distinguishing one component from another.

It is understood that when an element is referred to as being "connected" or "coupled" to another element, it may be directly connected or coupled to the other element, but other elements may exist in the middle. On the other hand, when an element is referred to as "directly connected" or "directly connected" to another element, it should be understood that no intervening element exists.

It should be understood that in this description, singular expressions include plural expressions unless the context clearly dictates otherwise, and terms such as "comprise" or "have" are intended to designate that there is a feature, number, step, operation, component, part, or combination thereof described in the specification, but do not preclude the existence or addition of one or more other features, numbers, steps, operations, components, parts, or combinations thereof.

Figure 2:
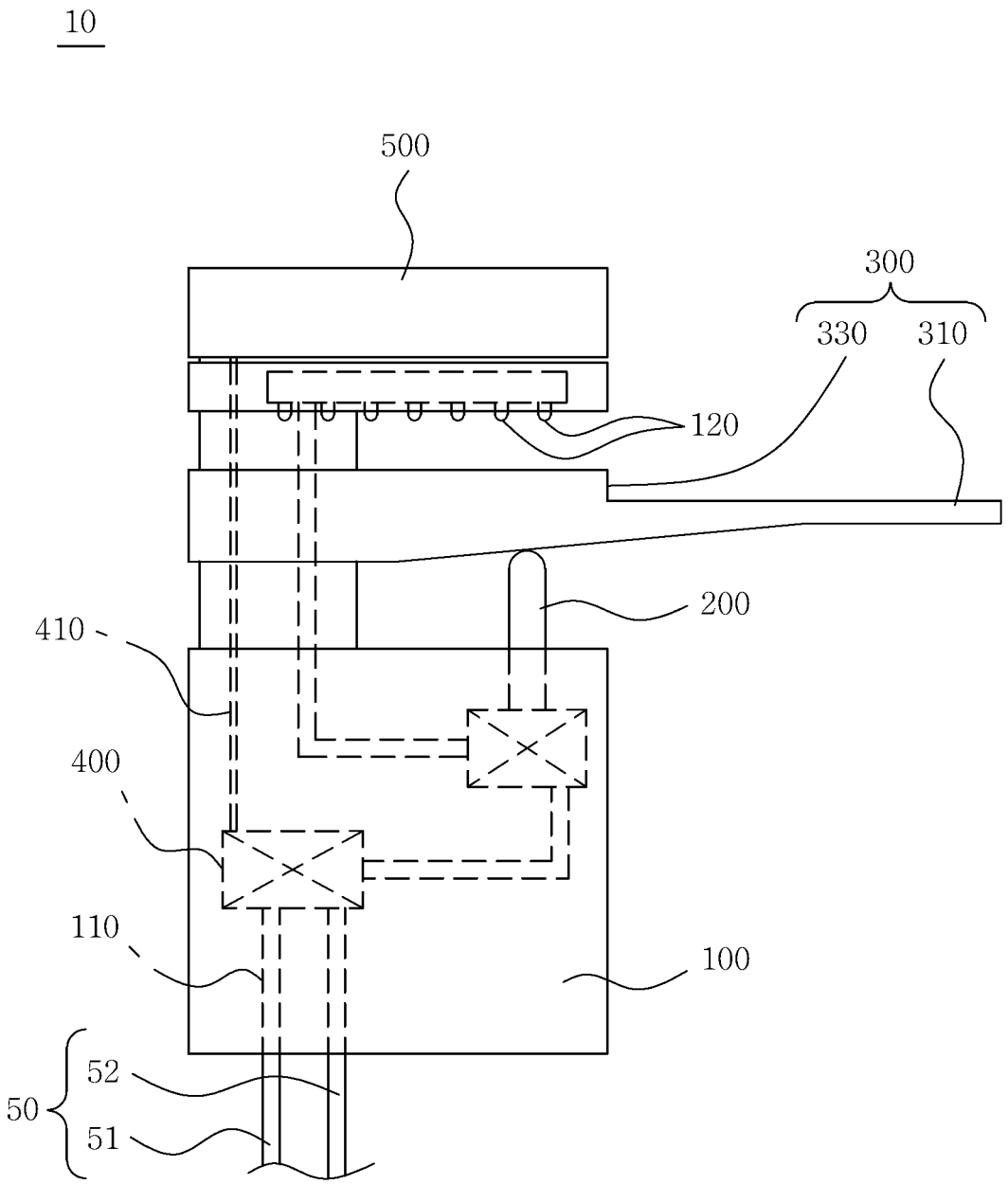
FIG. 2 is a configuration diagram showing a water supply state of a sanitary faucet according to an embodiment of the present invention.
Figure 3:
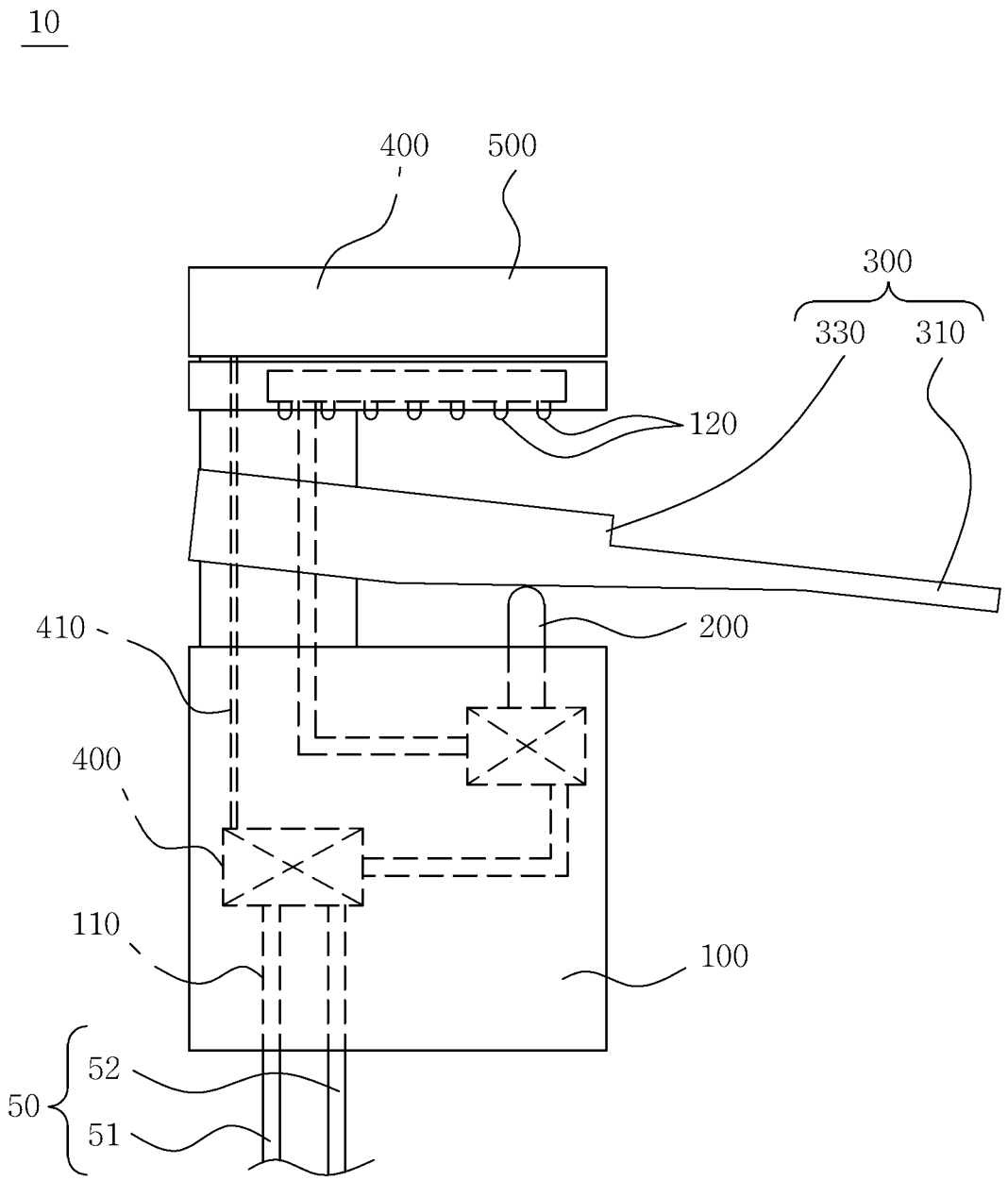
FIG. 3 is a configuration diagram showing a water-blocking state of a sanitary faucet according to an embodiment of the present invention.
Figure 4:
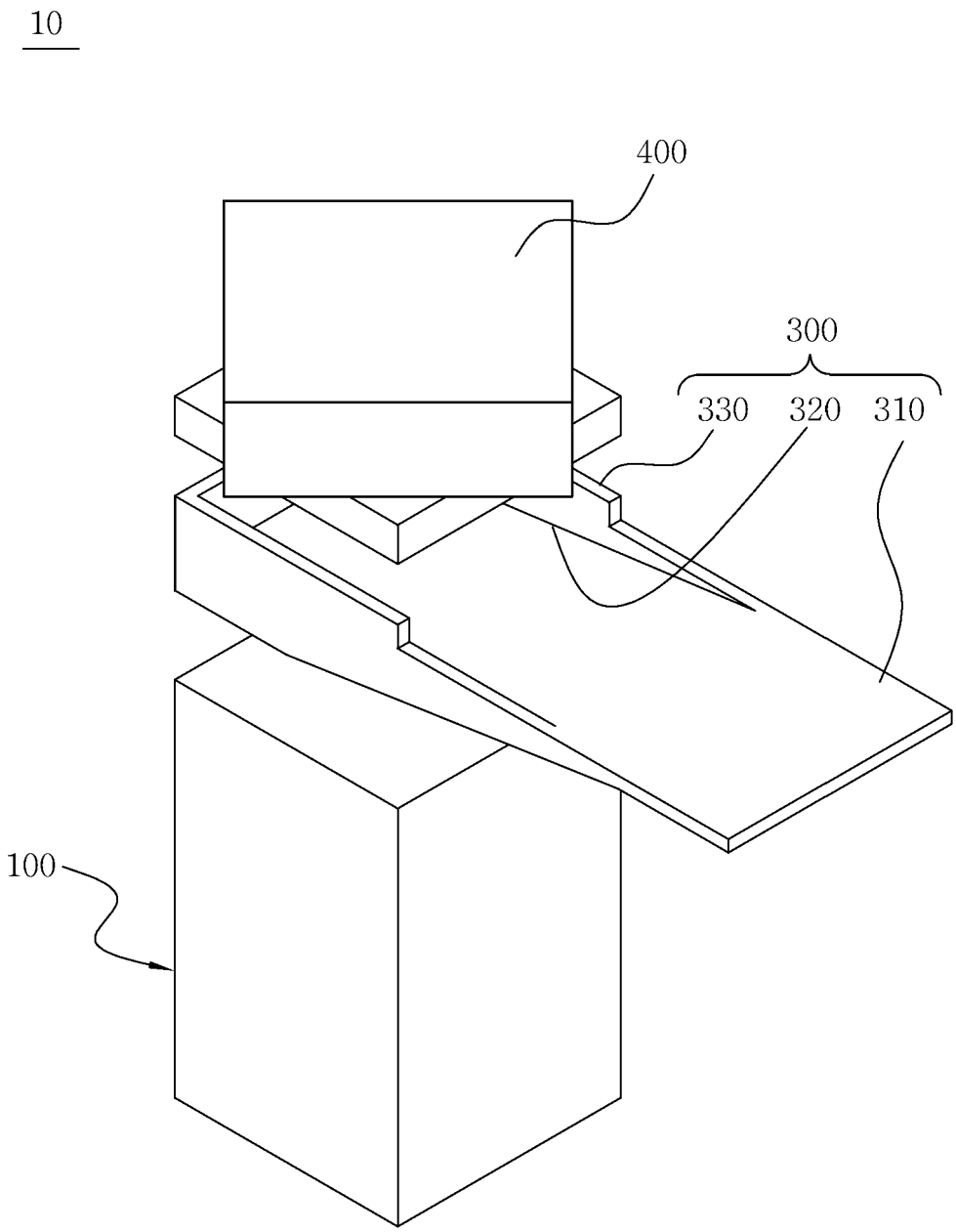
FIG. 4 is a perspective view showing a hot water supply state of a sanitary faucet according to an embodiment of the present invention.

FIG. 1 is a perspective view showing a sanitary faucet according to an embodiment of the present invention, FIG. 2 is a configuration diagram showing a water supply state of a sanitary faucet according to an embodiment of the present invention, and FIG. 3 is a configuration diagram showing a water-blocking state of a sanitary faucet according to an embodiment of the present invention. Further, FIG. 4 is a perspective view showing a hot water supply state of a sanitary faucet according to an embodiment of the present invention.

The sanitary faucet 10, according to an embodiment is a device installed in a washbasin or sink of a building to clean a body while discharging water from tap water, and in particular, a device capable of preventing bacterial infection or propagation by a knob touched by a user's hand.

Specifically, the sanitary faucet 10, according to an embodiment may include a faucet housing 100, a water supply valve 200, and a sanitary knob 300 as shown in FIGS. 1 and 2.

The faucet housing 100 is a component that is connected to the water supply line 50 of the tap water to form a water supply path, thereby discharging water.

Specifically, the faucet housing 100 may be connected to the water supply line 50 through a flow path 110 formed therein while being fixedly installed in a washbasin or sink, thereby forming a water supply path and be provided with a discharge port 120 to discharge the water of the flow path 110.

Here, the discharge port 120 may be formed on the top of the faucet housing 100 to discharge water toward the bottom, as shown in FIG. 2.

Further, the discharge port 120 may be formed in plural, as shown in FIG. 2, and unlike this, only one discharge port 120 may be formed to discharge water toward the bottom while discharging water to the sanitary knob 300 to be described later.

Further, the faucet housing 100 may be formed in a rectangular column shape as shown in FIG. 1 but is not limited thereto and may be formed in a cylindrical column shape or a polygonal column shape.

Meanwhile, the water supply line 50 may be composed of a cold water line 51 for supplying cold water and a hot water line 52 for supplying hot water, as shown in FIG. 2 and may be composed of only the cold water line 51 for supplying only cold water.

The water supply valve 200 is a component that supplies or blocks the water supply path formed by the flow path 110 of the faucet housing 100 and is operated by pressurization by the user to turn on/off the water in the flow path 110.

As shown in FIG. 2, the water supply valve 200 may be installed in a state of protruding from the faucet housing 100 and connected to the flow path 110 via the mixing valve 400 described later and may be operated by a user's pressurization through the sanitary knob 300 to be described later, the water of the flow path 110 can be communicated to be supplied or blocked.

The water supply valve 200 is connected to the mixing valve 400 and the flow path 110, is installed so as to be protruded or drawn into the faucet housing 100 to be in close contact with the bottom surface of the sanitary knob 300 described later, and the flow path 110 may be opened and closed by protruding or introducing in by the descending of the sanitary knob 300 by the user's pressurization.

Specifically, as shown in FIG. 2, the water supply valve 200 may protrude upward when the sanitary knob 300 is lowered by the user's pressurization to open the flow path 110, thereby supporting the sanitary knob 300 in a horizontal state, and as shown in FIG. 3, the sanitary knob 300 may be drawn downward by a user repeatedly lowering the sanitary knob 300 to close the flow path 110, thereby supporting the sanitary knob 300 in an inclined state.

For example, a configuration of a button applied to a conventional ballpoint pen may be applied to the water supply valve 200, which protrudes or is drawn in by repeated pressurization, thereby supporting the sanitary knob 300 in a horizontal or inclined state.

The sanitary knob 300 is a component that provides a user's touch area for pressurizing and operating the water supply valve 200 and may be disposed of between the outlet 120 and the water supply valve 200 by being installed in the faucet housing 100 so as to adjust the inclination.

The sanitary knob 300 may have a substantial plate shape and extends toward the front of the faucet housing 100 and guide the water discharged through the outlet 120 when the water supply valve 200 supplies water to the front of the faucet housing 100, thereby receiving a portion of the water on its upper surface, and when the water supply valve 200 is blocked, it can guide the received water to the front of the faucet housing 100 while forming an inclined state, thereby cleaning the area touched by the user.

Here, the sanitary knob 300 may be configured to include a knob body 310 having a flat upper surface.

Specifically, the upper surface of the knob body 310 is formed in a flat plate shape, is installed in the faucet housing 100 to enable tilt adjustment, and its bottom surface can be supported by the water supply valve 200. It can achieve a horizontal or inclined state by the protrusion or introduction of the water supply valve 200 by the user's touch.

That is, the knob body 310 is in a horizontal state when the water supply valve 200 supplies water, to guide the water falling from the outlet 120 to the front of the faucet housing 100, thereby receiving a portion of the water on the upper surface, and it may form an inclined state when the water supply valve 200 is blocked, to guide the water received in its upper surface to the front of the faucet housing 1000, thereby cleaning he area touched by the user.

The knob body 310 may be formed in the shape of a square plate, and on the other hand, all configurations in which the top surface is flat, such as a disk-shaped plate or a polygonal plate, may be applied.

Further, the sanitary knob 300 may further comprise a receiving groove 320 and groove guides 330, as shown in FIG. 2.

The receiving groove 320 and the groove guide 330 are components for smoothly receiving water on the upper surface of the knob body 310.

Specifically, the receiving groove 320 may be formed in a groove on the upper surface of the knob body 320 and formed in the lower part of the discharge port 120 and may receive a portion of water falling from the discharge port 120 in a horizontal state of the knob body 310.

Further, the groove guides 330 are installed in a vertical state on both sides of the receiving groove 320 to form a wall, thereby receiving water together with the receiving groove 320.

That is, the knob body 310 may guide the water falling from the discharge port 120 toward the user in a horizontal state when the water supply valve 200 supplies water and receive a portion of the water in the receiving groove 320 and the groove guides 330. When the water supply valve 200 is blocked, the water received in the receiving groove 320 and the groove guides 330 is guided toward the user in an inclined state, thereby cleaning the part touched by the user.

Meanwhile, the sanitary faucet 10 according to an embodiment may further comprise a mixing valve 400 and a hot water control knob 500.

The mixing valve 400 and the hot water control knob 500 are components for adjusting the mixing amount of cold water and hot water when the aforementioned water supply line 50 is composed of the cold water line 51 and the hot water line 52.

Specifically, the mixing valve 400 is built into the faucet housing 100 and installed on the flow path 110 connected to the cold water line 51 and the hot water line 52, and hot water and cold water may be mixed to supply the mixture to the water supply valve 200.

Further, the hot water control knob 500 is a component that allows the user to adjust the mixing valve 400 and may be connected to the mixing valve 400 through a rod 410 while being rotatably installed on the upper end of the faucet housing 100.

As shown in FIG. 4, the hot water control knob 500 is rotated by the user, thereby rotating the mixing valve 400 through the rod 410 to adjust the mixing amount of cold water and hot water.

Here, any configuration known in the faucet field may be applied to the mixing valve 400 as long as it is configured to increase or decrease the amount of hot water while being rotated by the hot water control knob 500.

A method of using the sanitary faucet 10 according to an embodiment of the present invention including the above components is described.

When washing his or her hands, the user touches the knob body 310 to lower it downward, thereby opening the water supply valve 200.

The water supply valve 200 opens the flow path 110 by pressurization of the knob body 310 and protrudes upward, thereby supporting the knob body 310 in a horizontal state.

Water in the water supply line 50 is discharged through the discharge port 120 by the opening of the water supply valve 200, falls to the upper surface of the knob body 310, and is guided along the upper surface of the knob body 310 to be supplied toward the user, thereby receiving a portion of water received in the receiving groove 320 and the groove guides 330.

When turning off the water, the user touches the knob body 310 again to lower it downward, thereby closing the water supply valve 200.

The water supply valve 200 closes the flow path 110 by pressurization of the knob body 310 and is drawn downward, thereby supporting the knob body 310 in an inclined state.

Accordingly, the water received in the receiving groove 320 and the groove guide 330 is guided along the inclined surface of the knob body 310 and moves toward the user to clean the user's touch area.

As seen above, in the sanitary faucet according to an embodiment of the present invention, the sanitary knob 100 that turns on and off the water supply valve receives a portion of water on the upper surface when water is supplied, and when the water is shut off, the user's touch area is washed with the received water, so infection or propagation of bacteria by the knob can be prevented.

It will be understood that the above-described embodiments are for illustrative purposes, and those skilled in the art to which the above-described embodiments belong will be able to understand that it can be easily modified into other specific forms without changing the technical spirit or essential features of the above-described embodiments. Therefore, it should be understood that the embodiments described above should be understood as illustrative in all respects and not limiting. For example, each component described as a single type may be implemented in a distributed manner, and similarly, components described as distributed may be implemented in a combined form.

The protective scope through this specification is indicated by the following claims rather than the detailed description above, and it should be construed to include all changes or modifications derived from the meaning and scope of the claims and equivalent concepts thereof.

DESCRIPTION OF REFERENCE NUMBERS

10: sanitary knob
50: water supply line
51: cold water supply line
52: hot water supply line
100: faucet housing
110: flow path
120: discharge port
200: water supply valve
300: sanitary knob
310: knob body
320: receiving groove
330: knob body
400: mixing valve
500: hot water control knob

The invention claimed is:

1. A sanitary faucet comprising:

a faucet housing configured to be connected to a water supply line to form a water supply path and have a discharge port through which water is discharged;

a water supply valve configured to be installed in the faucet housing and operated by a user's pressurization to supply or block water in the water supply path; and a sanitary knob configured to be disposed between the discharge port and the water supply valve in a state of being installed on the faucet housing such that the incline thereof may be adjusted so as to press the water supply valve by being touched by the user and to be extendedly formed to the front of the faucet housing so as to guide water discharged from the discharge port to the front of the faucet housing when the water is supplied by the water supply valve, wherein a portion of the water is received while forming a levelled state when the water is supplied by the water supply valve, and wherein a portion which was touched by the user is washed while forming a inclined state when the water supply valve is shut off, so as to guide the received water to the front of the faucet housing.

2. The sanitary faucet of claim 1, wherein the sanitary knob comprises a knob body forming a horizontal or inclined state by the operation of the water supply valve while the lower surface is supported by the water supply valve in a state of being installed in the faucet housing and having a upper surface which is formed in a flat shape and receiving, when it is in a horizontal state, a portion of the water while guiding the water falling from the discharge port.

3. The sanitary faucet of claim 2, wherein the sanitary knob further comprises:

a receiving groove formed on an upper surface of the knob body to form a groove and receiving water in a horizontal state of the knob body; and groove guides installed vertically on both sides of the receiving groove to form a wall and receiving water together with the receiving groove.

4. The sanitary faucet of claim 1, wherein the water supply valve is installed to be able to protrude from the faucet housing to adhere to the lower surface of the sanitary knob, opens the supply path by pressing the sanitary knob and protrudes to support the sanitary knob in a horizontal state, and closes the supply path by repetitive pressing of the sanitary knob to support the sanitary knob in an inclined state.

5. The sanitary faucet of claim 1, wherein the water supply line comprises:

a hot water line supplying hot water to the faucet housing; and a cold water line supplying cold water to the faucet housing.

6. The sanitary faucet of claim 5, further comprising:

a mixing valve built into the faucet housing to be connected to the hot water line and the cold water line, thereby mixing hot water and cold water and supply the mixture to the water supply valve; and a hot water control knob rotatably installed in the faucet housing while being connected to the mixing valve and rotates by a user to set the mixing amount of hot water and cold water of the mixing valve.

* * * * *